US008010029B2

(12) United States Patent
Kim et al.

(10) Patent No.: US 8,010,029 B2
(45) Date of Patent: Aug. 30, 2011

(54) FUSING DEVICE HAVING DECREASED WARM-UP TIME AND IMAGE FORMING APPARATUS HAVING THE SAME

(75) Inventors: Hwan Hee Kim, Suwon-si (KR); Chang Hoon Jung, Seoul (KR); Tae Gyu Kim, Gyeonggi-do (KR); Dong Jin Seol, Suwon-si (KR)

(73) Assignee: Samsung Electronics Co., Ltd, Suwon-Si (KR)

( * ) Notice: Subject to any disclaimer, the term of this patent is extended or adjusted under 35 U.S.C. 154(b) by 427 days.

(21) Appl. No.: 12/114,068

(22) Filed: May 2, 2008

(65) Prior Publication Data

US 2009/0016789 A1 Jan. 15, 2009

(30) Foreign Application Priority Data

Jul. 13, 2007 (KR) ..... 10-2007-0070519

(51) Int. Cl.
*G03G 15/20* (2006.01)

(52) U.S. Cl. ..... 399/329

(58) Field of Classification Search ..... 399/329, 399/328, 331
See application file for complete search history.

(56) References Cited

U.S. PATENT DOCUMENTS

| | | | | |
|---|---|---|---|---|
| 7,076,198 | B2 * | 7/2006 | Kim et al. | 399/330 |
| 7,623,817 | B2 * | 11/2009 | Jung et al. | 399/328 |
| 7,881,650 | B2 * | 2/2011 | Shin et al. | 399/329 |
| 2008/0187372 | A1 * | 8/2008 | Kato | 399/328 |
| 2008/0232871 | A1 * | 9/2008 | Jung et al. | 399/329 |
| 2009/0092423 | A1 * | 4/2009 | Shin et al. | 399/329 |

FOREIGN PATENT DOCUMENTS

| | | | |
|---|---|---|---|
| JP | 2004252301 A | * | 9/2004 |
| KR | 2006-90740 | | 8/2006 |

* cited by examiner

*Primary Examiner* — Quana M Grainger
(74) *Attorney, Agent, or Firm* — Stanzione & Kim, LLP

(57) ABSTRACT

A fusing device and an image forming apparatus having the same. The fusing device can include a fusing belt, a heat source disposed in an interior of the fusing belt, a supporting member to support at least a portion of an inner peripheral surface of the fusing belt, a press member mounted while opposing the fusing belt to form a fusing nip, and a nip forming part formed with an opening portion to enable heat emitted from the heat source to be transferred to the fusing belt at a position corresponding to the fusing nip. The nip forming part can have at least one gap maintaining part to prevent change of a gap of the opening portion. The nip forming part is provided at the supporting member or a nip forming member mounted between the heat source and the supporting member. Accordingly, a temperature of the fusing belt can rise quickly by directly heating the fusing belt, and deterioration of fusing performance due to deformation of the nip forming member can be prevented.

18 Claims, 6 Drawing Sheets

FUSING DEVICE HAVING DECREASED WARM-UP TIME AND IMAGE FORMING APPARATUS HAVING THE SAME

CROSS-REFERENCE TO RELATED APPLICATIONS

This application claims the benefit of Korean Patent Application No. 2007-0070519, filed on Jul. 13, 2007 in the Korean Intellectual Property Office, the disclosure of which is incorporated herein by reference in its entirety.

BACKGROUND OF THE INVENTION

1. Field of the Invention

The present general inventive concept relates to an image forming apparatus, and more particularly to a fusing device and an image forming apparatus having the same that fuses a toner image to a printing medium.

2. Description of the Related Art

An image forming apparatus is an apparatus that prints an image on a printing medium, e.g., paper, according to an input image signal. As one type of the image forming apparatus, an electrophotographic image forming apparatus is configured such that light is scanned to a photosensitive body which has been charged with a predetermined electric potential to form an electrostatic latent image on an outer peripheral surface of the photosensitive body. The electrostatic latent image is developed into a toner image by supplying a toner to the electrostatic latent image, and than the toner image is transferred onto paper. The toner image transferred onto the paper is just carried on the paper at this point, and is not fixed to the paper. Thus, the toner image necessarily passes through a fusing device provided in the image forming apparatus to be fused to the paper by heat and pressure.

A conventional fusing device includes a heat roller which has a heat source therein, and a press roller which is in close contact with the heat roller and forms a fusing nip at a contact portion with the heat roller. If the paper, onto which the toner image has been transferred, passes between the rotating heat roller and press roller, the toner image is fused to the paper by heat transferred from the interior of the heat roller and pressure generated at the fusing nip. However, in the conventional fusing device, because the heat roller itself has a large thermal capacity, it takes much time to heat the heat roller to a predetermined temperature, at which the fusing can be achieved, in initially driving the image forming apparatus.

In order to fulfill the requirements of high speed operation of the image forming apparatus, there has been recently developed a fusing device capable of increasing a temperature of a nip portion to a temperature for image fusing, as quickly as possible. An example of such a fusing device is disclosed in Korean Patent Laid-Open Publication No. 2006-0090740.

The disclosed fusing device includes a press roller, a fusing belt which rotates by being driven by the press roller, a halogen heater mounted in the interior of the fusing belt to heat the fusing belt, and a belt guide member supporting an inner surface of the fusing belt so that the fusing belt can form a fusing nip together with the press roller. In the above-structured fusing device, the heat emitted from the halogen heater heats the belt guide member, and the belt guide member transfers the heat to the fusing belt to heat the fusing belt.

The disclosed conventional fusing device can only shorten a warm-up time to a certain extent by using the fusing belt having a relatively small thermal capacity. However, because the heat is indirectly transferred to the fusing belt through the belt guide member, there is a limitation in increasing rapidly the temperature of the fusing belt.

Also, the disclosed conventional fusing device is designed without consideration of the deformation of the belt guide member forming the fusing nip due to the heat of a high temperature. Thus, it is highly possible that a width of the nip portion becomes narrow or the temperature of the fusing belt drops due to the thermal deformation of the belt guide member (if a contact area between the belt guide member and the fusing belt decreases due to the thermal deformation, the quantity of heat transferred to the fusing belt also decreases, and thus the temperature of the fusing belt drops). The decrease in the width of the nip portion or the drop of the temperature of the fusing belt causes deterioration of the fusing performance, and as a result deterioration of a printing quality or image inferiority occurs.

SUMMARY OF THE INVENTION

The present general inventive concept provides a fusing device and an image forming apparatus having the same that can quickly increase a temperature of a fusing belt by directly heating the fusing belt adjacent to a fusing nip by using a heat source.

The present general inventive concept also provides a fusing device and an image forming apparatus having the same that can prevent deterioration of fusing performance due to deformation of a member supporting the fusing belt to form the fusing nip.

Additional aspects and/or advantages of the general inventive concept will be set forth in part in the description which follows and, in part, will be obvious from the description, or may be learned by practice of the general inventive concept.

The foregoing and/or other aspects and utilities of the present general inventive concept may be achieved by providing a image forming apparatus having a fusing device, the fusing device including: a fusing belt; a heat source disposed in an interior of the fusing belt; a supporting member to support at least a portion of an inner surface of the fusing belt; a press member mounted while opposing the fusing belt to form a fusing nip; and a nip forming part formed with an opening portion to enable heat emitted from the heat source to be transferred to the fusing belt at a position corresponding to the fusing nip. The nip forming part is provided with at least one gap maintaining part to prevent change of a gap of the opening portion.

The nip forming part may be provided at the supporting member. The nip forming part may be provided at a nip forming member mounted between the heat source and the supporting member.

The at least one gap maintaining part may be arranged in a width direction of paper passing through the fusing nip.

Also, the at least one gap maintaining part may be arranged relatively concentratedly on a center portion of the nip forming part in the width direction of the paper passing through the fusing nip.

The at least one gap maintaining part may include two supporting plates to respectively support a first side surface of the opening portion and a second side surface of the opening portion which opposes the first side surface, and a gap maintaining pin to connect the supporting plates.

The at least one gap maintaining part may be integrally formed with the supporting member.

Also, the at least one gap maintaining part may be integrally formed with the nip forming member.

The nip forming member may include a body part surrounding the heat source. The nip forming part may include first and second extending portions extending from both ends of the body part toward the fusing belt to form the opening portion therebetween, and first and second press portions bent from the first and second extending portions to press the fusing belt.

The foregoing and/or other aspects and utilities of the present general inventive concept may also be achieved by providing a fusing device including: a fusing belt; a heat source provided in an interior of the fusing belt; a press member mounted while opposing the fusing belt to form a fusing nip; a supporting member to support an inner surface of the fusing belt to form the fusing nip with the press member, the supporting member being formed with an opening portion to enable heat emitted from the heat source to directly heat the fusing belt adjacent to the fusing nip; and at least one gap maintaining part to prevent change of a gap of the opening portion.

The foregoing and/or other aspects and utilities of the present general inventive concept may also be achieved by providing a fusing device including: a fusing belt; a heat source provided in an interior of the fusing belt; a press member mounted while opposing the fusing belt to form a fusing nip; a nip forming member to support an inner surface of the fusing belt to form the fusing nip with the press member, the nip forming member being formed with an opening portion to enable heat emitted from the heat source to directly heat the fusing belt adjacent to the fusing nip; a supporting member to support the nip forming member at an exterior of the nip forming member; and at least one gap maintaining part to prevent change of a gap of the opening portion.

The foregoing and/or other aspects and utilities of the present general inventive concept may also be achieved by providing a fusing device, including a fusing belt to fuse an image onto a recording medium; a press member to press the fusing belt to create a nip therebetween; and a supporting member to support an inner surface of the fusing belt to form the nip with the press member, the supporting member including a heat source disposed therein and an open portion at the nip to permit heat from the heat source to directly heat the fusing belt at the nip.

The supporting member can further include at least one heat penetrating portion to permit the heat from the heat source to penetrate the supporting member to directly heat the fusing belt at portions thereof other than at the portion at the nip.

The open portion of the supporting member comprises at least one gap maintaining part connecting opposing sides of the supporting member at the open portion to maintain a constant length of the open portion along a width of the recording medium.

BRIEF DESCRIPTION OF THE DRAWINGS

These and/or other aspects and advantages of the exemplary embodiments of the general inventive concept will become apparent and more readily appreciated from the following description of the embodiments, taken in conjunction with the accompanying drawings, of which.

DETAILED DESCRIPTION OF THE PREFERRED EMBODIMENTS

Figure 1:
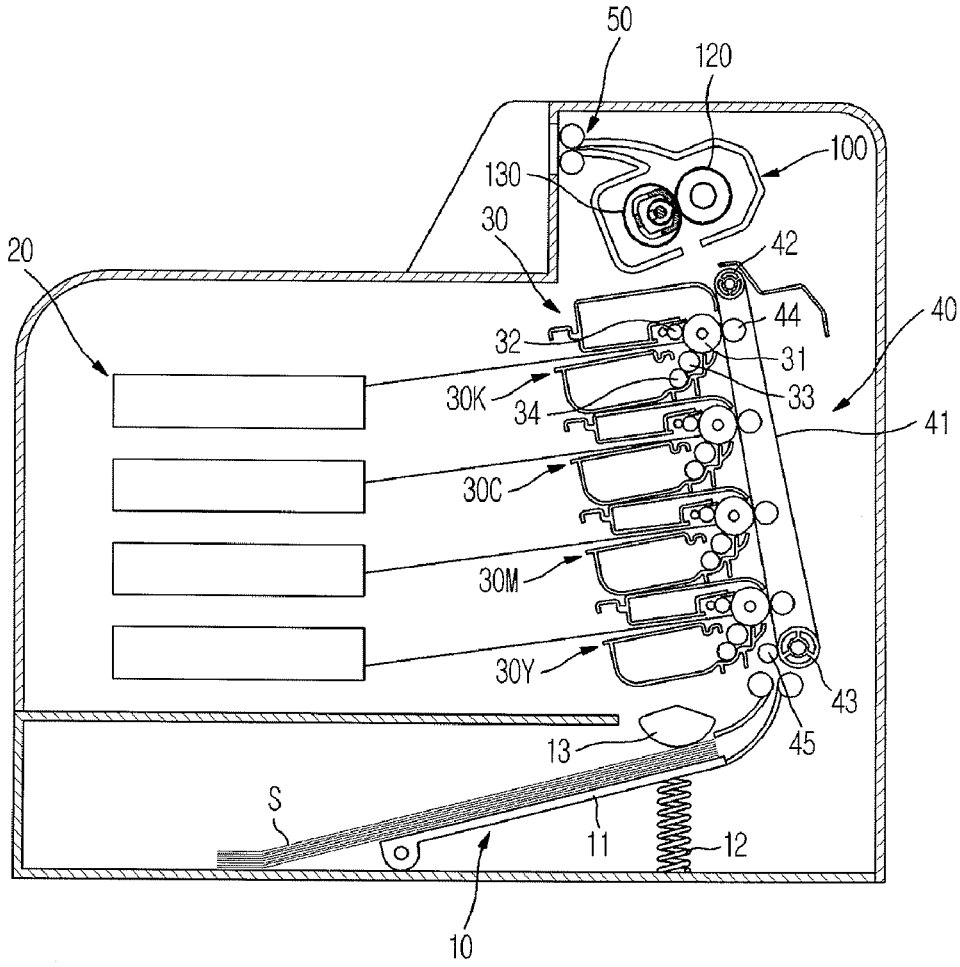
FIG. 1 is a sectional view illustrating a constitution of an image forming apparatus in accordance with an embodiment of the present general inventive concept.

Reference will now be made in detail to exemplary embodiments of the present general inventive concept, examples of which are illustrated in the accompanying drawings, wherein like reference numerals refer to like elements throughout. The embodiments are described below to explain the present general inventive concept by referring to the figures.

FIG. 1 is a sectional view illustrating a constitution of an image forming apparatus in accordance with an embodiment of the present general inventive concept.

As illustrated in FIG. 1, an image forming apparatus according to this embodiment includes a paper feeding device 10, an exposure device 20, a developing device 30, a transfer device 40, a fusing device 100, and a paper discharge device 50.

The paper feeding device 10 to supply a printing medium, i.e., paper S, includes a paper feeding tray 11 to load the paper S thereon, and a spring 12 to elastically support the paper feeding tray 11. The paper S loaded on the paper feeding tray 11 is picked up by a pickup roller 13 sheet by sheet, and is fed toward the developing device 30.

The developing device 30 includes four developing cartridges 30Y, 30M, 30C and 30K in which toners of different colors, e.g., yellow (Y), magenta (M), cyan (C) and black (K) toners are respectively stored. The developing cartridges 30Y, 30M, 30C and 30K are respectively provided with photosensitive bodies 31 on which electrostatic latent images are formed by the exposure device 20. The exposure device 20 irradiates light, corresponding to image information of yellow (Y), magenta (M), cyan (C) and black (K), to the photosensitive bodies 31 of the developing cartridges according to a printing signal.

Each of the developing cartridges 30Y, 30M, 30C and 30K includes a charge roller 32 to charge each photosensitive body 31, a developing roller 33 to develop the electrostatic latent image formed on each photosensitive body 31 into a toner image, and a supply roller 34 to supply the toner onto the developing roller 33.

The transfer device 40, to transfer the toner images developed on the photosensitive bodies 31 onto the paper, includes a transfer belt 41 which circulates while contacting the photosensitive bodies 31, a transfer belt driving roller 42 to drive the transfer belt 41, a tension roller 43 to keep the tension of the transfer belt 41 constant, four transfer rollers 44 to transfer the toner images developed on the photosensitive bodies 31 onto the paper, and a transfer belt charge roller 45 to charge the transfer belt 41 by contacting the transfer belt 41.

Figure 2:
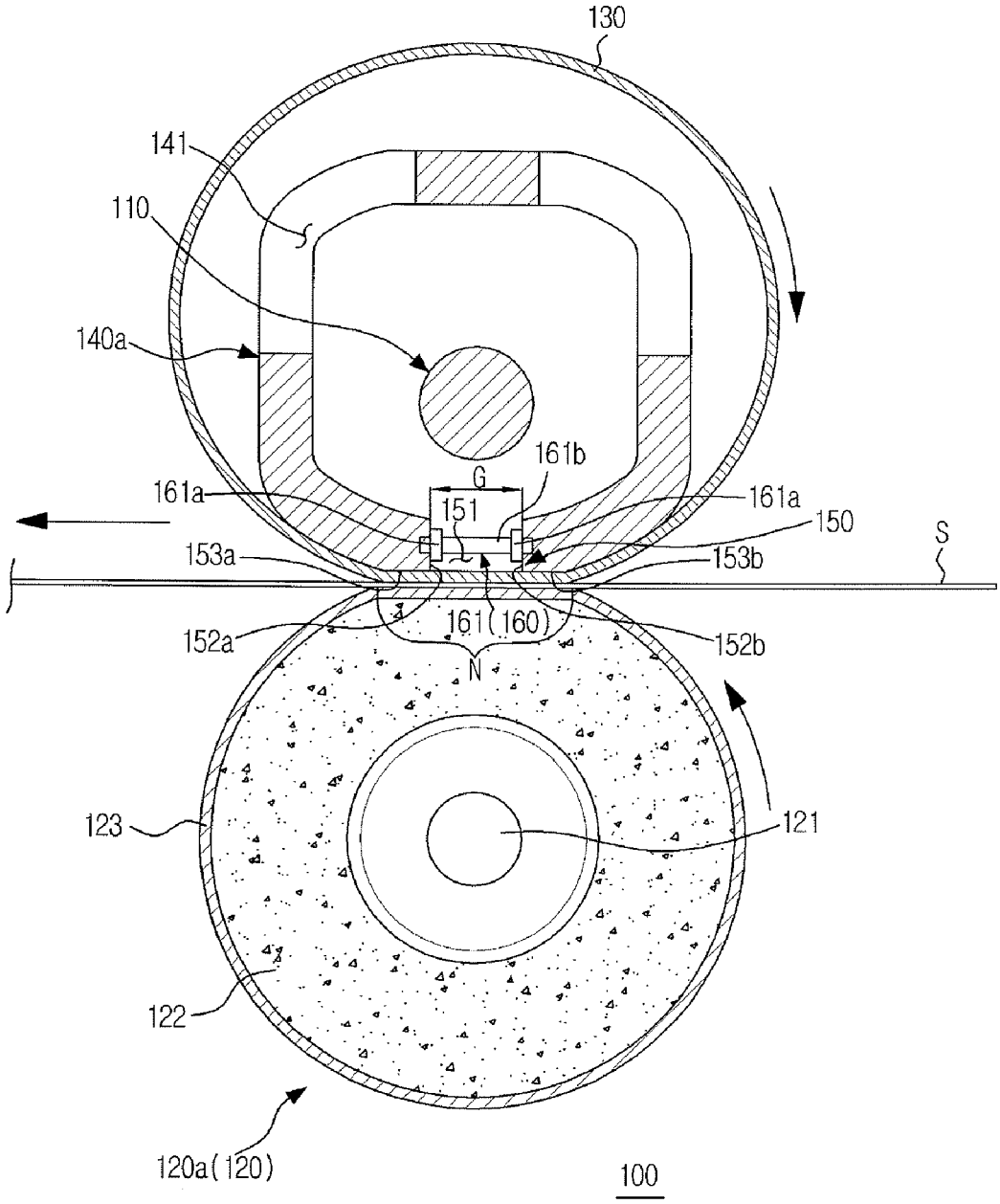
FIG. 2 is a sectional view illustrating a constitution of a fusing device in accordance with an embodiment of the present general inventive concept.
Figure 3:
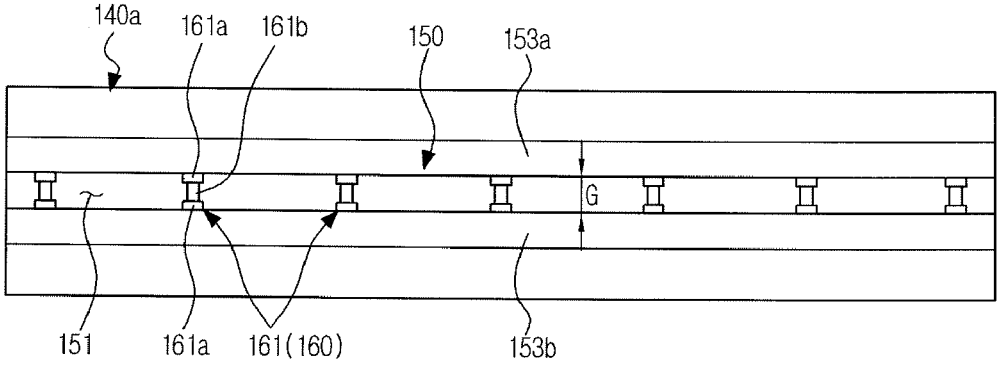
FIGS. 3 and 4 are bottom views illustrating a gap maintaining part provided at a supporting member of the fusing device depicted in FIG. 2.
Figure 4:
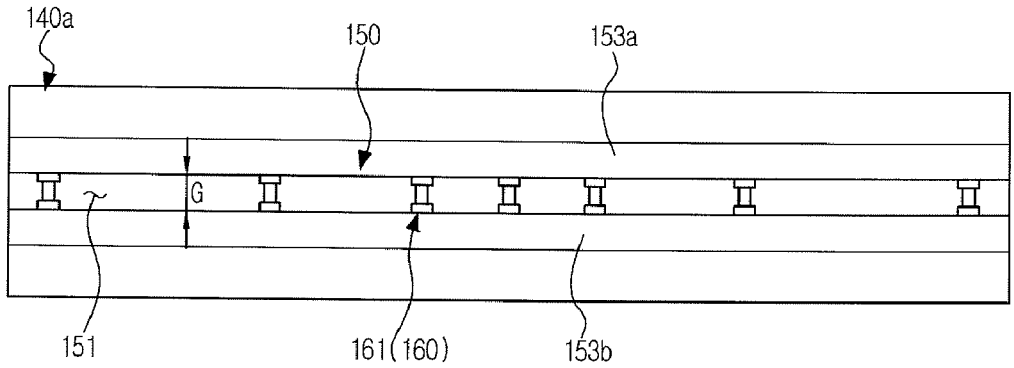
Figure 5:
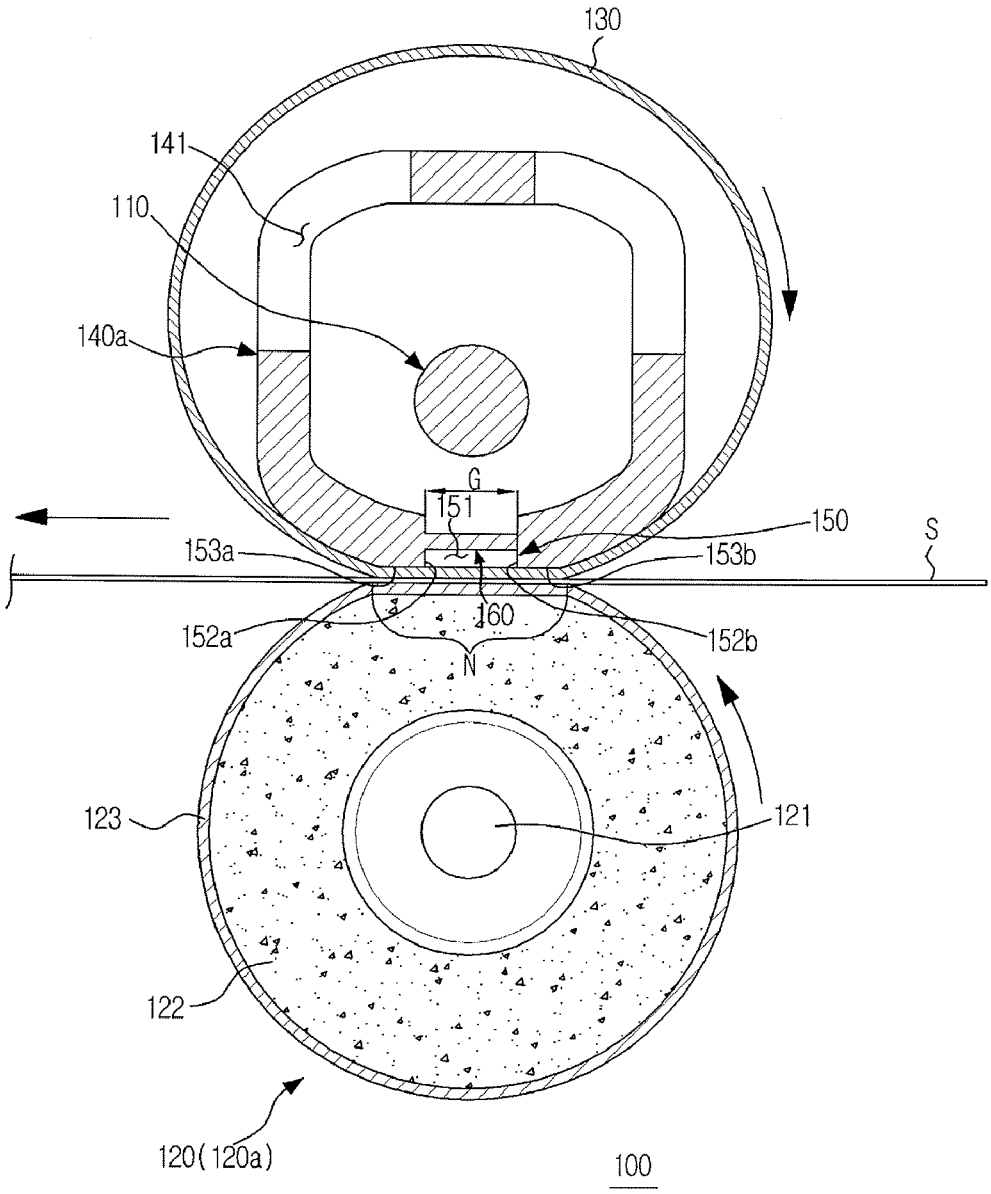
FIG. 5 is a sectional view illustrating a constitution of a fusing device in accordance with another embodiment of the present general inventive concept.

FIG. 2 is a sectional view illustrating the constitution of the fusing device according to an embodiment of the present general inventive concept, and FIGS. 3 and 4 are bottom views illustrating a gap maintaining part provided at a supporting member of the fusing device depicted in FIG. 2. FIG. 5 is a sectional view illustrating the constitution of the fusing device according to another embodiment of the present general inventive concept.

As illustrated in the embodiments of both FIGS. 2 and 5, the fusing device 100 includes a heat source 110, a press member 120, a fusing belt 130, and a supporting member 140*a*. When the paper S, onto which the toner image has been transferred, passes between the press member 120 and the fusing belt 130, the toner image is fused to the paper by heat and pressure.

The press member 120 is disposed while opposing the fusing belt 130, and is pressed toward the fusing belt 130 by a press means (not shown) to form a fusing nip N. The press member 120 may be configured as a press roller 120*a* which rotates by receiving power from a driving source (not shown). The press roller 120*a* includes a shaft 121 made of a metal material such as aluminum or steel, and an elastic layer 122 surrounding the shaft 121. As the press roller 120*a* is pressed toward the fusing belt 130, the elastic layer 122 is elastically deformed to form the fusing nip N between the press roller 120*a* and the fusing belt 130. The elastic layer 122 is commonly made of a silicone rubber. The elastic layer 122 is provided with a release layer 123 on its surface to prevent adherence of the paper to the press roller 120*a*.

The fusing belt 130 circulates interlockingly with the press roller 120*a*, and forms the fusing nip N with the press roller 120*a*. The fusing belt 130 is made of a heat resistant material, and has a width corresponding to a length of the press roller 120*a*. The fusing belt 130 is heated by the heat source 110 disposed in the interior of the fusing belt 130, and transfers the heat to the paper S passing through the fusing nip N.

The supporting member 140*a* is provided between the heat source 110 and the fusing belt 130, and supports at least a portion of an inner peripheral surface of the fusing belt 130 so that the fusing nip N is formed between the press roller 120*a* and the fusing belt 130. The supporting member 140*a* is formed to surround the heat source 110, and is made of a material having a large rigidity so as not to be easily deformed by an external force.

The fusing device 100 includes a nip forming part 150 which is formed with an opening portion 151 so that the radiant heat from the heat source 110 can be directly transferred to the fusing belt 130 at a position corresponding to the fusing nip N. It is exemplified in FIGS. 2 and 5 that the nip forming part 150 is provided at the supporting member 140*a*.

The nip forming part 150 includes two opening forming surfaces 152*a* and 152*b* provided opposite to each other to define the opening portion 151 therebetween, and two press surfaces 153*a* and 153*b* to press the fusing belt 130 toward the press roller 120*a* to form the fusing nip N.

The heat source 110 can directly heat the fusing nip N formed by the fusing belt 130 through the opening portion 151 of the nip forming part 150, and accordingly the temperature of the fusing belt 130 adjacent to the fusing nip N can rise quickly. The supporting member 140*a* includes a heat penetration portion 141. The radiant heat from the heat source 110 penetrates the heat penetration portion 141 of the supporting member 140*a*, and is directly transferred to the fusing belt 130. The heat penetration portion 141 can include a plural holes or slits formed therein to allow the heat to pass therethrough.

The fusing device 100 of the embodiments of FIGS. 2 and 5 may further include at least one gap maintaining part 160 to prevent a gap G of the opening portion 151 from becoming narrow due to the thermal deformation. The gap maintaining part 160 maintains the gap G of the opening portion 151 constant, thereby preventing a decrease in the width of the fusing nip N or a decrease in the quantity of heat transferred to the fusing belt 130.

As illustrated in FIG. 2, the gap maintaining part 160 may be configured as a gap maintaining member 161 which is provided separately from the supporting member 140*a*. The gap maintaining member 161 includes two supporting plates 161*a* to respectively support the opening forming surfaces 152*a* and 152*b* which oppose each other, and a gap maintaining pin 161*b* to connect two supporting plates 161*a*. Both ends of the gap maintaining pin 161*b* are fixed to the supporting member 140*a*. Because the gap maintaining member 161 is exposed to the heat emitted from the heat source 110, the gap maintaining member 161 is made of a material having a superior heat resistant property.

As illustrated in FIGS. 3 and 4, at least one gap maintaining member 161 is arranged in a length direction of the nip forming part 150 (width direction of the paper passing through the fusing nip N, hereinafter will be referred to as "width direction of the paper" for convenience of explanation). The above-arranged gap maintaining member 161 maintains the gap G of the opening portion 151 constant in the width direction of the paper. Although FIGS. 3 and 4 illustrate that seven gap maintaining members 161 are mounted, the number of the gap maintaining member 161 can be adequately changed as needed by the design.

FIG. 3 illustrates that seven gap maintaining members 161 are arranged with a regular interval in the width direction of the paper. FIG. 4 illustrates that seven gap maintaining members 161 are arranged relatively concentratedly on a center portion of the nip forming part 150 in the width direction of the paper. The reason for concentratedly arranging the gap maintaining members 161 at the center portion of the nip forming part 150 is that the gap of the opening portion 151 decreases most greatly at the center portion when the supporting member 140*a* is thermally deformed.

As illustrated in FIG. 5, the gap maintaining part 160 may be integrally formed with the supporting member 140*a*. In such a case, the gap maintaining part 160 connects two opening forming surfaces 152*a* and 152*b* of the supporting member 140*a* across the opening portion 151. Similarly to FIG. 3, the plural gap maintaining parts 160 may be arranged with a regular interval in the width direction of the paper. Similarly to FIG. 4, the plural gap maintaining parts 160 may be arranged concentratedly on the center portion of the nip forming part 150.

Figure 6:
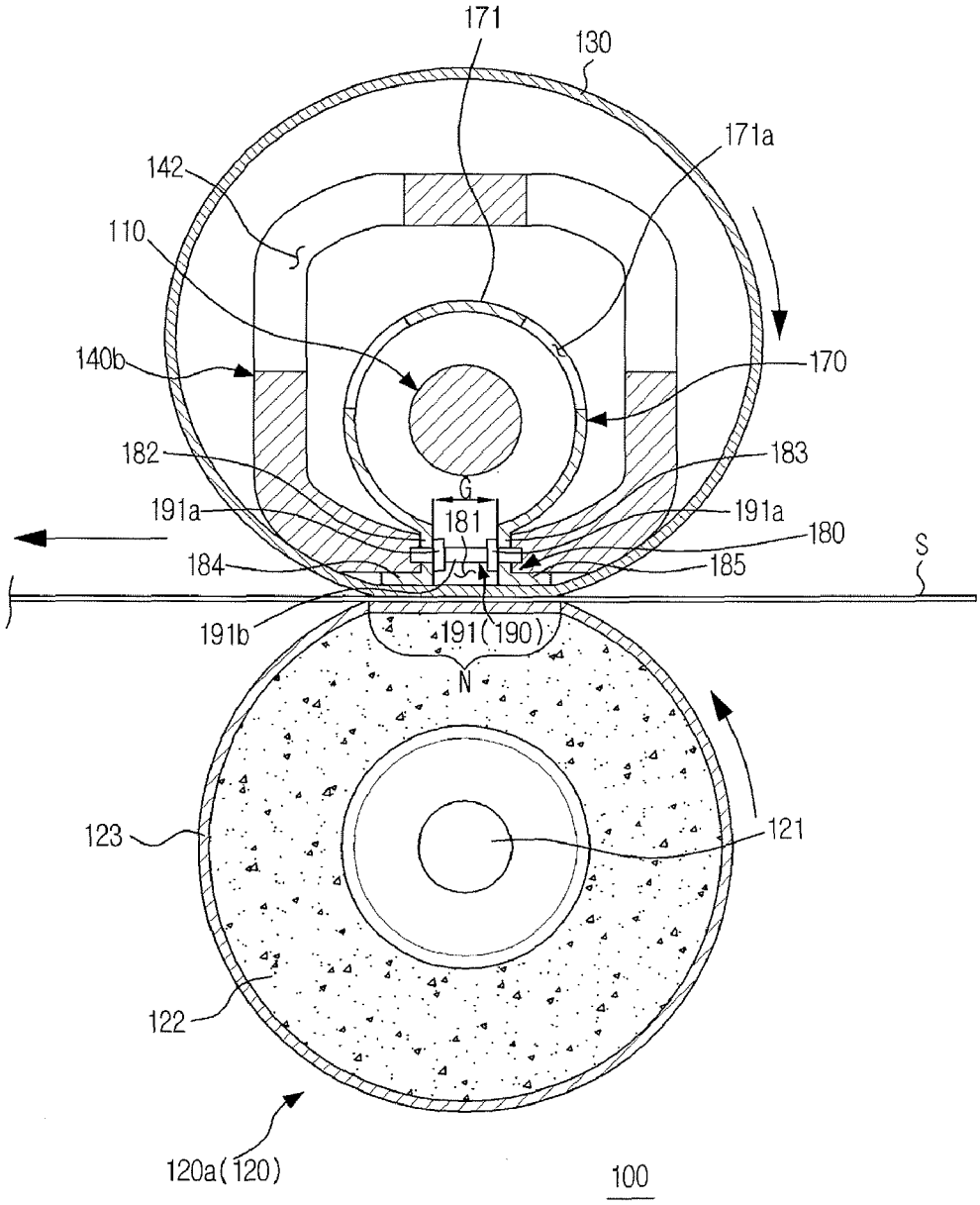
FIG. 6 is a sectional view illustrating a constitution of a fusing device in accordance with yet another embodiment of the present general inventive concept.

FIG. 6 is a sectional view illustrating the constitution of the fusing device according to another embodiment of the present general inventive concept. When compared to the embodiment in FIG. 2 constituted such that the nip forming part is provided at the supporting member, this embodiment is constituted such that the nip forming part is provided at an additional nip forming member. Hereinafter, the features of this embodiment, distinguished over the previous embodiments, will be described, and the same elements as FIG. 2 are denoted by the same reference numerals.

A nip forming member 170 is mounted between the heat source 110 and the fusing belt 130, and a supporting member 140*b* is mounted to the outside of the nip forming member 170.

The nip forming member 170 supports an inner peripheral surface of the fusing belt 130 so that the fusing nip N is formed between the press roller 120*a* and the fusing belt 130. The nip forming member 170 includes a body part 171 surrounding the heat source 110, and a nip forming part 180 formed with an opening portion 181 so that the radiant heat from the heat source 110 can be directly transferred to the fusing belt 130 at a position corresponding to the fusing nip N.

The nip forming part 180 includes a first extending portion 182 which extends toward the fusing belt 130 from one end of the body part 171, a second extending portion 183 which extends toward the fusing belt 130 from the other end of the body part 171, and first and second press portions 184 and 185 which are respectively bent from the first extending portion 182 and the second extending portion 183 so that one side surface of each press portion can press the inner peripheral surface of the fusing belt 130.

An opening portion 181 is defined between the first extending portion 182 and the second extending portion 183. The heat source 110 can directly heat the fusing nip N formed by the fusing belt 130 through the opening portion 181, and accordingly the temperature of the fusing belt 130 adjacent to the fusing nip N can rise quickly.

The nip forming member 170 is heated by the radiant heat from the heat source 110, and the heated nip forming member 170 transfers the heat to the fusing belt 130 and the paper S through the first press portion 184 and the second press portion 185. Preferably, the nip forming member 170 is made of a metal material having small specific heat and superior heat conductive properties so that the temperature of the nip forming member 170 can rise as fast as possible to effectively transfer the heat to the fusing belt 130 and the paper S.

The body part 171 of the nip forming member 170 is provided with a first heat penetration portion 171*a*. The heat emitted from the heat source 110 can be directly transferred to the fusing belt 130 through the first heat penetration portion 171*a* of the nip forming member 170. Accordingly, the fusing belt 130 can be heated more rapidly, and the drop of the temperature of the fusing belt 130 during the circulation of the fusing belt 130 can be prevented. The first heat penetration portion 171*a* may be configured as plural holes or slits which are arranged with a regular interval in a length direction of the nip forming member 170.

The supporting member 140*b* is provided with a second heat penetration portion 142. After penetrating the first penetration portion 171*a* of the nip forming member 170, the radiant heat from the heat source penetrates the second heat penetration portion 142 of the supporting member 140*b*, and is directly transferred to the fusing belt 130. The second heat penetration portion 142 is provided at a position corresponding to the first heat penetration portion 171*a* of the nip forming member 170 in an emission direction of the radiant heat, and is formed larger than the corresponding first heat penetration portion 171*a*.

Both lower ends of the supporting member 140*b* support and press the other side surfaces of the first and second press portions 184 and 185 (surfaces opposite to the surfaces supporting the fusing belt 130) against the pressing force applied from the press roller 120*a*. Both the lower ends of the supporting member 140*b* also support outer surfaces of the first and second extending portions 182 and 183 of the nip forming member 170 to prevent the increase in the gap G of the opening portion 181 due to the thermal deformation.

The fusing device 100 of this embodiment further includes at least one gap maintaining part 190 to prevent the decrease in the gap G of the opening portion 181 due to the thermal deformation. As illustrated in FIG. 6, the gap maintaining part 190 may be configured as a gap maintaining member 191 which is provided separately from the nip forming member 170.

The gap maintaining member 191 includes two supporting plates 191*a* which respectively support inner surfaces of the first extending portion 182 and the second extending portion 183, and a gap maintaining pin 191*b* to connect two supporting plates 191*a*. One end of the gap maintaining pin 191*b* is fixed to the supporting member 140*b* through the first extending portion 182, and the other end of the gap maintaining pin 191*b* is fixed to the supporting member 140*b* through the second extending portion 183.

Similarly to FIG. 3, the plural gap maintaining members 191 may be arranged with a regular interval in the width direction of the paper. Similarly to FIG. 4, the plural gap maintaining members 191 may be arranged concentratedly on the center portion. Although this embodiment describes that the gap maintaining member 191 is mounted to the nip forming member 170, the gap maintaining part may be integrally formed with the nip forming member, similarly to FIG. 5.

Hereinafter, operations of the fusing device and the image forming apparatus according to embodiments of the present general inventive concept will be described with reference to FIGS. 1 and 6.

If power is applied to the image forming apparatus, the heat source 110 of the fusing device 100 heats the fusing belt 130 and the nip forming member 170 to an optimum temperature adequate to perform the fusing operation. The heat emitted from the heat source 110 directly heats the fusing belt 130 adjacent to the fusing nip N through the opening portion 181 of the nip forming part 180, and also directly heats the fusing belt 130 through the heat penetration portions 171*a* and 142 of the nip forming member 170 and the supporting member 140*b*. Since the heat source 110 directly heats the fusing belt 130, the temperature of the fusing belt 130 can rise quickly. The heat source 110 also heats the nip forming member 170, and the heated nip forming member 170 transfers the heat to the fusing belt 130 through the press portions 184 and 185. Since the gap G of the opening portion 181 of the nip forming part 180 is maintained constant by the gap maintaining member 191, the change of the width of the fusing nip N due to the thermal deformation of the nip forming member 170 does not occur. Further, since the gap G of the opening portion 181 is maintained constant, the heat emitted from the heat source 110 evenly passes through the opening portion 181 in the width direction of the paper, thereby uniformly heating the fusing belt 130.

If the fusing belt 130 is heated to the optimum temperature through the above-described process, the printing operation is started according to a user's command. In other words, an electrostatic latent image corresponding to image information is formed on the surface of the photosensitive body 31 by the exposure device 20, and the developing device 30 supplies the toner to the photosensitive body 31 and develops the electrostatic latent image into a toner image. The paper S is supplied through the paper feeding device 10, and the transfer device 40 transfers the toner image on the photosensitive body 31 onto the paper S supplied from the paper feeding device 10. The toner image transferred paper passes between the press roller 120*a* and the fusing belt 130 in the fusing device 100. At this time, the toner image is fused to the paper by the heat transferred from the fusing belt 130 and the pressure applied between the press roller 120*a* and the fusing belt 130. After the fusing operation, the paper is discharged to the outside by the paper discharge device 50.

As apparent from the above description, the fusing device according to the various embodiments of the present general inventive concept can rapidly raise the temperature of the fusing belt adjacent to the fusing nip because the heat source can directly heat the fusing belt through the opening portion of the nip forming part. Accordingly, a warm-up time is shortened and high speed printing can be achieved.

Further, since the gap maintaining part prevents the decrease in the gap of the opening portion, the width of the fusing nip can be maintained constant in the width direction of the paper, and the fusing belt can be heated uniformly in the width direction of the paper. Accordingly, the fusing performance can be stably maintained Although embodiments of the present general inventive concept have been shown and described, it would be appreciated by those skilled in the art that changes may be made in this embodiment without departing from the principles and spirit of the general inventive concept, the scope of which is defined in the claims and their equivalents.

What is claimed is:

1. An image forming apparatus having a fusing device, the fusing device comprising:

a fusing belt;

a heat source disposed in an interior of the fusing belt;

a supporting member to support at least a portion of an inner surface of the fusing belt;

a press member mounted while opposing the fusing belt to form a fusing nip; and a nip forming part formed with an opening portion to enable heat emitted from the heat source to be transferred to the fusing belt at a position corresponding to the fusing nip, the nip forming part being provided with a plurality of gap maintaining parts to prevent change of a gap of the opening portion, wherein the plurality of gap maintaining parts are arranged in a width direction of paper passing through the fusing nip and the heat emitted from the heat source is transferred through spaces between the plurality of gap maintaining parts, and wherein the area of the opening portion is larger than the sum of each area of the plurality of gap maintaining parts.

2. The image forming apparatus according to claim 1, wherein the nip forming part is provided at the supporting member.

3. The image forming apparatus according to claim 1, the fusing device further comprising:

a nip forming member mounted between the heat source and the supporting member, wherein the nip forming part is provided at the nip forming member.

4. The image forming apparatus according to claim 1, wherein the at least one gap maintaining part is arranged relatively concentratedly on a center portion of the nip forming part in a width direction of paper passing through the fusing nip.

5. The image forming apparatus according to claim 1, wherein the at least one gap maintaining part includes two supporting plates to respectively support a first side surface of the opening portion and a second side surface of the opening portion which opposes the first side surface, and a gap maintaining pin to connect the supporting plates.

6. The image forming apparatus according to claim 2, wherein the at least one gap maintaining part is integrally formed with the supporting member.

7. The image forming apparatus according to claim 3, wherein the at least one gap maintaining part is integrally formed with the nip forming member.

8. The image forming apparatus according to claim 3, wherein the nip forming member includes a body part surrounding the heat source, and wherein the nip forming part includes first and second extending portions extending from both ends of the body part toward the fusing belt to form the opening portion therebetween, and first and second press portions bent from the first and second extending portions to press the fusing belt.

9. A fusing device comprising:

a fusing belt;

a heat source provided in an interior of the fusing belt;

a press member mounted while opposing the fusing belt to form a fusing nip;

a supporting member to support an inner surface of the fusing belt to form the fusing nip with the press member, the supporting member being formed with an opening portion to enable heat emitted from the heat source to heat the fusing belt adjacent to the fusing nip; and a plurality of gap maintaining parts to prevent change of a gap of the opening portion, wherein the plurality of gap maintaining parts are arranged in a width direction of paper passing through the fusing nip and the heat emitted from the heat source is transferred through spaces between the plurality of gap maintaining parts, and wherein the area of the opening portion is larger than the sum of each area of the plurality of gap maintaining parts.

10. The fusing device according to claim 9, wherein the at least one gap maintaining part includes at least one gap maintaining member mounted in the opening portion.

11. The fusing device according to claim 9, wherein the at least one gap maintaining part is integrally formed with the supporting member.

12. A fusing device comprising:

a fusing belt;

a heat source provided in an interior of the fusing belt;

a press member mounted while opposing the fusing belt to form a fusing nip;

a nip forming member to support an inner surface of the fusing belt to form the fusing nip with the press member, the nip forming member being formed with an opening portion to enable heat emitted from the heat source to heat the fusing belt adjacent to the fusing nip;

a supporting member to support the nip forming member at an exterior of the nip forming member; and a plurality of gap maintaining parts to prevent change of a gap of the opening portion, wherein the plurality of gap maintaining parts are arranged in a width direction of paper passing through the fusing nip and the heat emitted from the heat source is transferred through spaces between the plurality of gap maintaining parts, and wherein the area of the opening portion is larger than the sum of each area of the plurality of gap maintaining parts.

13. The fusing device according to claim 12, wherein the at least one gap maintaining part includes at least one gap maintaining member mounted in the opening portion.

14. The fusing device according to claim 12, wherein the at least one gap maintaining part is integrally formed with the nip forming member.

15. A fusing device, comprising:

a fusing belt to fuse an image onto a recording medium;

a press member to press the fusing belt to create a nip therebetween; and a supporting member to support an inner surface of the fusing belt to form the nip with the press member, the supporting member including a heat source disposed therein and an open portion at the nip to permit heat from the heat source to heat the fusing belt at the nip, wherein the open portion of the supporting member comprises a plurality of gap maintaining parts connecting opposing sides of the supporting member at the open portion to maintain a constant length of the open portion along a width of the recording medium and arranged in a width direction of recording medium passing through the nip, and wherein the heat emitted from the heat source is transferred through spaces between the plurality of gap maintaining parts, and wherein the area of the open portion is larger than the sum of each area of the plurality of gap maintaining parts.

16. The fusing device according to claim 15, wherein the supporting member further includes:

at least one heat penetrating portion to permit the heat from the heat source to penetrate the supporting member to directly heat the fusing belt at portions thereof other than at the portion at the nip.

17. The fusing device according to claim 16, wherein the at least one heat penetrating portion includes a plurality of holes or slits arranged at regular intervals to allow the heat to pass therethrough to the fusing belt.

18. An image forming apparatus having a fusing device, the fusing device comprising:

a fusing belt defining an interior space;

a press member to press the fusing belt to create a nip therebetween;

a supporting member disposed in the interior space to support the fusing belt;

a heat source disposed in the interior space to emit heat; and a nip forming part to form an opening portion at the support member to expose the fusing belt to the interior space, wherein the opening portion of the supporting member comprises a plurality of gap maintaining parts connecting opposing sides of the supporting member at the opening portion to maintain a constant length of the opening portion along a width of the recording medium and arranged in a width direction of paper passing through the nip, and wherein the heat generated by heat source is transferred through spaces between the plurality of gap maintaining parts, and wherein the area of the opening portion is larger than the sum of each area of the plurality of gap maintaining parts.

* * * * *